United States Patent [19]

Brandelli

[11] 4,094,327

[45] June 13, 1978

[54] FLUID CONTROL DEVICE

[76] Inventor: Anthony R. Brandelli, 2418 W. 256th St., Lomita, Calif. 90717

[21] Appl. No.: 766,356

[22] Filed: Feb. 7, 1977

[51] Int. Cl. ..... F16k 21/18

[52] U.S. Cl. ..... 137/403; 4/345; 4/422; 137/414; 137/426; 251/46; 285/303; 285/322

[58] Field of Search ..... 4/34, 57 P, 67 A; 137/403, 406, 412, 413, 414, 426, 434; 285/303, 322, 390; 251/45, 46, 30

[56] References Cited

U.S. PATENT DOCUMENTS

| | | | |
|---|---|---|---|
| 1,095,884 | 5/1914 | Kerstner | 285/303 |
| 1,478,452 | 12/1923 | Nelson | 285/322 |
| 2,442,927 | 6/1948 | Horvath | 137/403 |
| 2,620,818 | 12/1952 | Symmons | 137/403 |
| 2,685,301 | 8/1954 | Dreier | 137/403 |
| 2,827,073 | 3/1958 | Owens | 137/426 |
| 3,586,017 | 6/1971 | Walters | 137/403 |
| 3,693,649 | 9/1972 | Gordon et al. | 251/45 |
| 3,797,518 | 3/1974 | Holm et al. | 137/434 |
| 3,895,645 | 7/1975 | Johnson | 251/46 |
| 3,917,218 | 11/1975 | Marocco | 251/30 |

*Primary Examiner*—Martin P. Schwadron
*Assistant Examiner*—G. L. Walton
*Attorney, Agent, or Firm*—Fulwider, Patton, Rieber, Lee & Utecht

[57] ABSTRACT

There is disclosed a liquid level control valve ideally suited for water closets and the like that employs a submersed liquid pressure responsive diaphragm as an actuator for the control valve. The control valve is supported in the tank on a liquid inlet vertical column, above the normal, controlled liquid level thereon. The control valve has a flexible valve closure member that subdivides the control valve housing into main and secondary chambers. A small orifice provides liquid communication through the diaphragm between the chambers and the secondary chamber is provided with a bleed orifice in the housing wall with a closure member therefor carried on an actuator arm which is mechanically coupled through a vent pipe to the diaphragm actuator. Response of the actuator, to liquid pressure causes a downward deflection of the diaphragm which moves the bleed orifice closure member into a closed position, applying the liquid pressure in the secondary chamber onto the flexible inlet valve closure member whereby this member seats and seals the inlet port of the valve. The entire valve structure, as well as the vent pipe from the actuator, communicate to the atmosphere above the liquid level of the tank, thereby insuring a truly antisyphon operation.

29 Claims, 8 Drawing Figures

FIG. 1
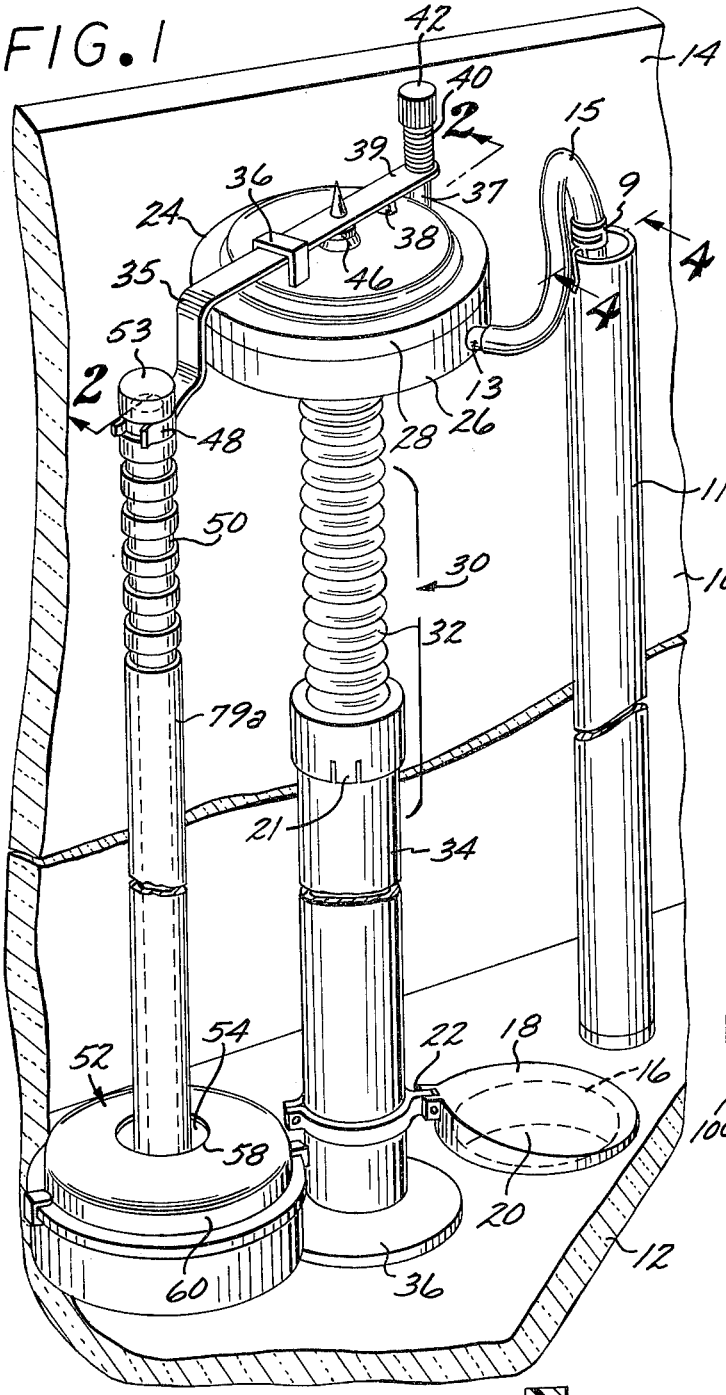
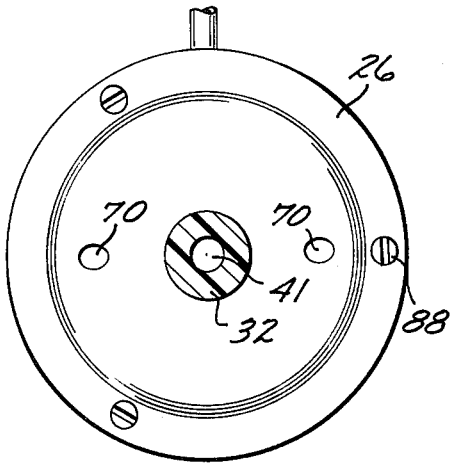
FIG. 5
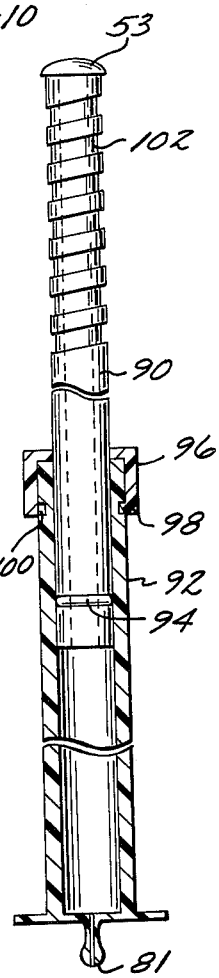
FIG. 6
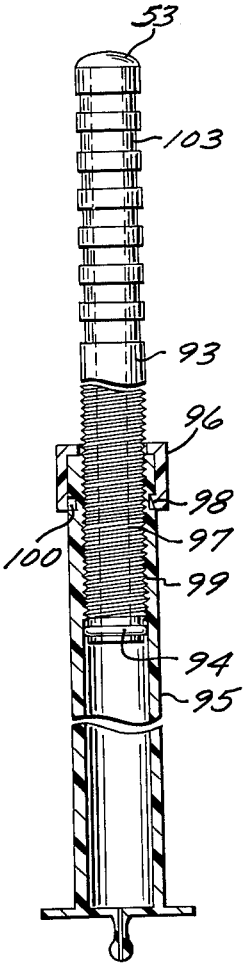
FIG. 7
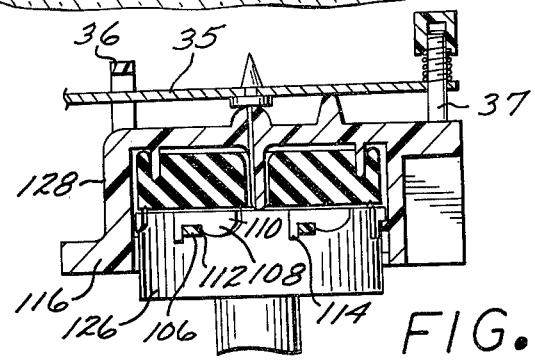
FIG. 8

FLUID CONTROL DEVICE

BACKGROUND OF THE INVENTION

1 Field of the Invention

This invention relates to a liquid level control valve and, in particular to a valve useful in a water closet and the like.

2. Brief Statement of the Prior Art

The ubiquious float actuated ballcock valve of conventional water closets has many operational disadvantages. The valve is a fairly complex structure of multiple parts, prone to wear and consequential failure and expensive to manufacture. A recent attempt has been made to market a substitute for this conventional valve which is described in U.S. Pat. No. 3,895,645. The device of the aforementioned patent employs a floor-mounted, flexible diaphragm actuator that is mechanically linked to the inlet water valve. Both the actuator and the inlet water valve are mounted on the floor of the tank and the air chamber beneath the diaphragm of the actuator is vented through an aperture in the pipe fitting of the device.

While the aforedescribed valve mechanism is an improvement over the ubiquious and failure-prone ballcock valve, the patented device does not provide a truly antisyphon operation. It is essential, however, that the level control valves used for water closets provide antisyphon operation since these water closets are customarily connected to the municipal water supply which furnishes potable water to the homes of municipal users.

BRIEF STATEMENT OF THE INVENTION

This invention comprises a liquid level control valve having an improved, truly antisyphon operation. The control valve is contained within a housing that is carried on the upper end of a vertical, liquid inlet conduit. The control valve utilizes a flexible diaphragm actuator which is contained within an actuator housing that is mounted on the floor of the water tank. The actuator housing is subdivided by the flexible diaphragm into superior and subjacent chambers, with vent means to provide open communication between the superior chamber and the water tank whereby the flexible diaphragm receives and is responsive to the pressure head of liquid within the water tank. The subjacent air chamber beneath the diaphragm is vented, through a vertical vent conduit to the atmosphere above the liquid level in the water tank and the upper end of this vent conduit is mechanically coupled to an actuator arm which controls the inlet valve operation. The inlet liquid control valve is, preferably, of a construction employing a flexible valve closure member which extends across the inlet valve housing, subdividing it into main and secondary chambers. The secondary chamber is vented to the inlet liquid supply through a small pin restrictive orifice and is vented externally of the housing through a bleed orifice. The actuator arm carries a closure member between open and closed registration with the bleed orifice, whereby this bleed orifice can be closed in response to the actuator movement. Preferably, the vertical water inlet conduit and, also most preferably, the actuator vent conduit, are vertically adjustable with detent means for fixedly securing their positions to accomodate for varied liquid levels and or water tank sizes.

DESCRIPTION OF THE DRAWINGS

The invention will be described by reference to the illustrations of which:

FIG. 1 is a perspective view of the control valve and actuator mechanism of the invention;

FIG. 5 is a view along lines 5—5 of FIG. 3;

FIGS. 6 and 7 are partial sectional elevational views of alternative actuator vent conduits; and FIG. 8 illustrates an alternative, twist lock engagement of the members of the inlet valve housing.

DESCRIPTION OF THE PREFERRED EMBODIMENTS

Figures 2, 3, 4:
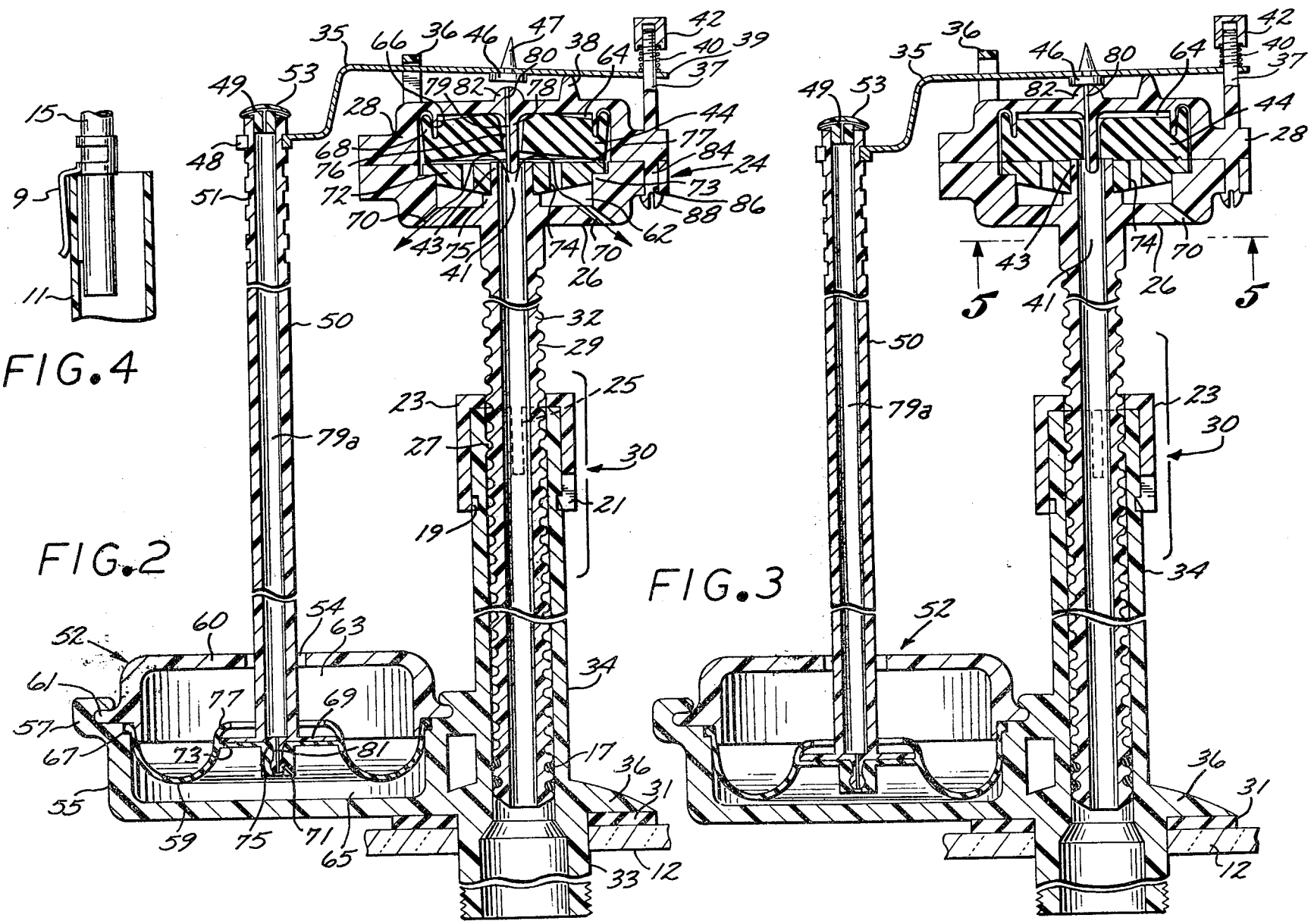
FIGS. 2 and 3 are sectional elevational views of the valve and actuator of the invention in open and closed positions, respectively.
FIG. 4 illustrates the attachment of a bypass line to the overflow standpipe of a water closet.

Referring now to FIG. 1, the invention is illustrated as installed in a water tank, typically a water closet 10 having a bottom wall 12 and side walls such as 14. As conventional in this construction, the tank 10 has a bottom outlet port 16 that is closed with a conventional flapper valve 18 having a bulbous closure member 20 which seats in the outlet port 16 and which is pivotally secured to supporting structure internally of the tank by bracket 22.

The liquid level control valve of the invention comprises a control valve housing 24 formed of a base plate member 26 and a cover plate member 28 that are detachably secured. The base plate is carried on the upper end of a vertical liquid inlet conduit 30 which, preferably, is formed with an upper conduit 32 that is telescopically received in a base column 34. The base column 34 has an annular flange 36 that seats on bottom wall 12 of tank 10.

The main chamber 62 of the valve housing 24 (shown) in FIGS. 2 and 3) is vented to the bowl, through hose fitting 13, and refill hose 15, to tank overflow conduit 11 which discharges to the bowl. The hose 15 can be attached to the conduit by clip 9 as shown in FIG. 4.

The cover plate 28 pivotally supports a valve actuator arm 35 which has one end secured to upright post 37 and which passes over abutment 38 that provides a rounded fulcrumed support therefor. The end 39 of actuator arm 35 has a bore that is resiliently received over post 37 by coil spring 40 that is biased between the upper surface of the actuator arm and adjustment nut 42 whereby the resilient bias of spring 40 can be fixedly adjusted. The actuator arm 35 is a flexing, springing member that carries a bleed orifice closure member 46 near its midportion. The free end of actuator arm 35 is mechanically linked to actuator vent conduit 50 by resilient clamp means such as spring clip 48.

The actuator of the invention comprises housing 52 which contains a flexible pressure diaphragm 59 having its upper surface vented to the tank contents through an annular space 54 between central aperture 58 in the cover plate member of 60 of the actuator housing and actuator vent conduit 50.

Referring now to FIGS. 2 and 3, the internal structure of the control valve and actuator will be described. The lower end of base column 34 of the vertical liquid inlet conduit 30 has an externally threaded boss 33 which can be received within a conventional pipe fitting such as an internally threaded union or pipe nipple and the like. The boss 33 receives an annular gasket or rubber washer 31 which seals against the bottom wall 12 of the water tank. The bottom plate member 26 of valve housing 24 is preferably integral with the inlet liquid conduit 32. Preferably, the latter has vertical position detenting means which can be in the form of a plurality of annular grooves 29 axially spaced along the conduit 32 which cooperate with one or more protrusions 27 carried on the upper portions of the inner wall of base column 34. The upper end of base column 34 also bears one or more axial slots 25 to permit limited freedom of expansion of the upper portion of column 34 and receives a removable end cap 23 which is secured thereon by snap fit means such as a dog 21 which seats in an annular groove 19 in the outer wall of base column 34. The telescoping interengagement of liquid inlet conduit 32 and base column 34 is sealed by one or more O-rings 17.

The inlet valve structure includes an inlet port 41 with valve seat means 43 extending thereabout. A flexible valve closure member 44 is mounted within the valve housing 24 subdividing this housing into a main chamber 62 and an auxiliary chamber 64. The flexible member 44 is secured in the assembly by an annular flange 66 that projects inwardly from the undersurface of the cover member 28 and is received in an annular groove 68 of the flexible valve member 44. The main chamber 62 of the valve housing has one or more outlet ports 70 which are preferably fan-shaped to provide a flat, fan spray discharge of liquid from the valve housing.

The main chamber 62 also contains a diffuser plate member 72 having a plurality of apertures 74 to provide a diffused flow of liquid from inlet port 41 through the chamber to outlet ports 70. The diffuser plate is supported by an outer annular shoulder 73 and inner annular shoulder 75. The upper surface of the plate 72 has an annular, sharp-edged rim 77 to provide a support for flexible member 44.

The flexible valve member 44 has a central orifice 76 which provides liquid communication between the main and auxiliary chambers 62 and 64. This orifice can be partially restricted by a pin member 78 that is downwardly dependent from the undersurface of cover plate 28 which can be splined with one or more grooves 79 and can have a blunt or rounded end.

Auxiliary chamber 64 is vented through housing 24 by orifice 80 which extends through the bulbous bead 82 on the upper surface of plate member 28.

The assembly of base plate member 26 and upper plate member 28 can be secured by suitable snap action locking means such as a plurality of posts 84 which are received in mating aperture 86 of base plate member 26 and which have a bulbous slotted head 88 which snaps about the undersurface of the plate member upon assembly. The number and spacing of posts 84 can be seen in FIG. 5. Alternatively a plurality of screws or other fasteners can be used.

As previously mentioned, the cover plate member 28 bears upright post 37 which bears distal, external threads for engagement by cap nut 42, retaining coil spring 40 biased against secured end 39 of actuator lever arm 35. The lever or flexible spring-actuator arm 35 carries the bleed orifice closure member 46 which is moveable between open and closed registration with the bleed orifice 80 in housing 24. The bleed orifice closure member 46 can be molded of a flexible material such as rubber and the like and can bear a shank 47 having an annular groove received in a mounting aperture of arm 35. The cover plate 28 can support a bracket member 36 which extends over arm 35 to provide an abutment that stops upward movement of the arm.

Arm 35 rests fulcrumed supported on abutment 38 which preferably has a rounded crown and which is integrally carried by cover plate member 28. The free end 45 of arm 35 is mechanically linked to actuator vent conduit 50 with a spring clamp 48, previously described. Preferably, vent column 50 has a plurality of annular grooves 51 distally interspaced thereon to provide a plurality of attachment points for spring clip 48. The upper end of the vent conduit 50 bears a removeable closure cap 53 having a small diameter orifice 49 to provide open communication to the atmosphere.

The actuator mechanism includes the actuator 52 formed of a base, cup-shaped member 55 and a cover plate member 60 having an annular flange 61 that is received by a plurality of clamps 57, preferably integrally formed with the base cup member 55.

A flexible diaphragm 59 is mounted within housing 52, subdividing the housing into a superior chamber 63 and a subjacent chamber 65. The flexible diaphragm 59 is secured in the housing by an annular bead 67 which is captured between the base cup member 55 and cover plate member 60.

The actuator vent conduit 50 distally bears an annular flange 69 and a terminal spherical boss 71. Diaphragm 59 has a flat central area 73 with a central aperture 75 to receive annular flange 69 and spherical boss 71, which is positively sealed therein. The flange 69 is captured in the assembly by lip 77. The internal passageway **79*a* of vent conduit 50 thereby provides open communication from subjacent chamber 65 to the atmosphere while sealing the chamber from superior chamber 63. The latter chamber is, as previously mentioned, open to the liquid within tank 10 through annular space 54 in cover plate member 60**.

The actuator and valve of the invention are shown in FIG. 2 with the valve in the open position. The valve is moved to this position by the resilient movement of flexible diaphragm 59 to its relaxed position shown in FIG. 2 which raises actuator vent conduit 50 a sufficient distance to pivot arm 35 and raise orifice closure member 46 from its closed registration with bleed orifice 80 when the tank contents are drained through opening 16. Since bleed orifice 80 communicates with auxiliary chamber 64 of the valve housing, the internal pressure of auxiliary chamber 64 is reduced by flow of liquid through bleed orifice 80, unbalancing the pressures on flexible valve closure member 44 and permitting the supply pressure of liquid at port 41 to lift the valve closure member to the illustrated position whereby liquid can flow through port 41, apertures 74 of diffuser plate 72 and out of the valve housing through the fan shaped apertures 70 as shown by the solid, arrowhead lines. Apertures 70 are above the controlled liquid level, thereby serving also as the primary antisyphon ports of the valve structure.

As the liquid level rises in tank 10, the static pressure applied to the upper surface of diaphragm 59 steadily increases until the pressure is sufficient to overcome the resiliency of the diaphragm and deflect the diaphragm downwardly to the position shown in FIG. 3. The movement of this diaphragm 59 can be dampened by the preselection of the air passageways such as the small diameter passageway 81 in boss 71 of vent conduit 50 and/or of slot means 49 in end cap 53 carried by conduit 50. The downward movement of vent conduit 50 carries arm 35 to the position shown in FIG. 3 where closure member 46 is in sealing relationship to bleed orifice 80. Consequently, auxiliary chamber 64 is pressured to the supply pressure of liquid through orifice 76 and the flexible valve closure member 44 is thereby deflected against valve seat means 43 whereby inlet port 41 is closed, ceasing the discharge of liquid through discharge ports 70.

As previously mentioned, the vertical position of the valve housing 24 can be fixedly adjusted by the telescopic assembly of inlet conduit 32 and base column 34. This adjustment is made by removing end cap 23 from base column 34, thereby freeing the upper end of the base column for flexing outwardly. This permits the liquid inlet conduit 32 to be moved axially in its telescoping engagement with base column 34 as the upper end of this column can be deflected sufficiently to permit protrusions 27 to spread sufficiently to release the annular groove 29 captured thereby. Once the desired vertical position of the valve housing is secured, the position can be fixedly secured by snapping end cover 23 in place.

In preferred embodiments, the actuator vent conduit 50, which is shown in FIGS. 1–3 as a single, fixed-length element, is substituted with telescoping assemblies permitting variable adjustment of the height of this conduit. FIGS. 6 and 7 illustrate alternative constructions wherein the vent conduit is shown as a upper conduit 90 that is telescopically received in a base conduit 92 with sealing means such as O-ring 94. The upper end of base conduit 92 can bear an end cap 96 secured thereto by a snap detenting means such as dog 98 which removably seats in an annular groove 100 about the upper end of the base conduit 92. As shown in FIG. 6, the upper end of vent conduit 90 can bear a plurality of annular grooves 102 which can be inclined to the axis of the conduit if desired.

Referring now to FIG. 7, the telescoping engagement of the upper conduit 93 and base conduit 95 can also be obtained by external threads 97 and O-ring 94 on the received end of conduit 93 which mate with internal threads 99 on the upper end of conduit 95. FIG. 7 illustrates annular grooves 103 disposed at right angles to the longitudinal axis of the conduit 93.

Referring now to FIG. 8, an alternative interlocking of the upper plate member 128 and base plate member 126 is shown. The twist lock means can comprise a plurality of peripherally spaced abutments 106 externally carried about the upper end of base member 126. The interior surface of the cover plate member 128 can bear a matching number of peripherally spaced detent members 108 having an arcuate leading edge 110, a groove 112 and limiting stop 114.

The invention has been described with reference to the illustrated and presently preferred embodiment thereof. It is not intended that the invention be unduly limited by this description of the illustrated and preferred embodiment. Instead, it is intended that the invention be defined by the means, and their obvious equivalents set forth in the following claims.

I claim:

1. A liquid level responsive valve for mounting in a tank having bottom wall inlet and outlet ports which comprises:

a valve housing having a cover member received on a bottom plate member defines an interior chamber, the latter having an inlet port, valve seat means thereabout, and outlet port means for discharging into said tank;

a vertical, liquid conduit with a first end in open communication with said tank inlet port and supporting said valve housing at an elevated position, about the full liquid level, in said tank;

a valve closure member contained within said valve housing and moveable between open and closed registration with said valve seat means;

valve member actuator means extending from the chamber of said valve housing exteriorly thereof;

a flexible valve actuator arm with one end secured for pivotal movement to the exterior of said housing and interconnected with said valve closure member to move said member between said open and closed positions upon pivotal movement of said actuator arm;

an actuator housing formed of a cover plate member received on a cup member for mounting on the fllor of said tank;

a flexible diaphragm peripherally sealed to the inner walls of said actuator housing and extending thereacross to subdivide said housing into superior and subjacent chambers;

a central aperture in said cover plate member of said housing;

a vertical vent conduit extending through said central aperture and vertically coextensive with said liquid inlet conduit, centrally carried on said flexible diaphragm in open communication with said subjacent chamber;

liquid vent means opening said superior chamber to said tank; and attachment means securing the free end of said actuator lever arm to the upper end of said vertical vent conduit.

2. The valve of claim 1 wherein said valve closure member is a flexible member displaceable between open and closed positions to said valve seat means and extending across said valve housing to form main and secondary valve chambers therein.

3. The valve of claim 2 wherein said valve closure member includes orifice means communicating between said chambers and bleed orifice means in the cover member of said valve housing communicating with said secondary chamber and wherein said means interconnecting said valve actuator arm therewith comprises a bleed orifice closure member secured to said actuator arm for movement between open and closed registration with said bleed orifice.

4. The valve of claim 3 wherein said cover member of said valve housing bears a downwardly dependent pin received in said orifice means.

5. The valve of claim 4 wherein said pin can have at least one axial groove.

6. The valve of claim 3 wherein said inlet and outlet port means extend through the bottom wall of said valve housing.

7. The valve of claim 3 wherein said valve actuator arm rests on a raised abutment on the upper exterior surface of said valve housing to provide a fulcrumed support therefor.

8. The valve of claim 7 wherein said raised abutment has a rounded crown to support said actuator arm.

9. The valve of claim 7 wherein the upper exterior surface of said housing bears an upright post which receives and secures an end of said actuator arm.

10. The valve of claim 9 wherein said post bears resilient means captured between said arm and adjustable retainer means to provide an adjustably fixed bias to said arm.

11. The valve of claim 1 wherein said cover member of said valve housing supports a bracket member over said flexible valve actuator arm for a vertical stop therefor.

12. The valve of claim 1 wherein the upper end of said vertical vent column has a plurality of annular grooves to provide a plurality of vertically variable receptables for said attachment means interconnecting said vertical column to said flexible actuator arm.

13. The valve of claim 1 wherein said liquid inlet vertical column is adjustably extendable.

14. The valve of claim 13 wherein said liquid inlet vertical column is telescopingly received in a base column with sealing means therebetween.

15. The valve of claim 14 wherein said liquid inlet vertical column has axial detenting means to fixedly secure the extension of said vertical column in said base column.

16. The valve of claim 15 wherein said axial detenting means comprises external threads on said vertical column engaged with internal threads on said base column.

17. The valve of claim 14 wherein said liquid inlet vertical column has axial detenting means in the form of a plurality of annular grooves carried on said vertical column with detenting protrusions on the upper portions of the inner wall of said base column, thereby locking said columns together.

18. The valve of claim 17 wherein the upper end of said base column is slotted to permit limited freedom of expansion of the upper portion of said base column.

19. The valve of claim 18 including cap means removably received over the end of said base column with snap attachment means to lock said cap means to said base column.

20. The valve of claim 1 wherein said valve seat means comprises an axial projection of said valve inlet port, internally of said valve housing.

21. The valve of claim 20 wherein said outlet port means have an outwardly expanding taper to develop a fan-shaped discharge spray.

22. The valve of claim 21 wherein said flexible diaphragm is responsive to the pressure of a head of liquid of less height than said vertical liquid conduit and said outlet port means is thereby supported above the controlled liquid level to serve also an anti-syphon means.

23. The valve of claim 20 wherein said valve housing contains difuser plate means supported in said valve housing between said inlet valve seat means and said outlet port means.

24. The valve of claim 1 wherein said valve housing is formed by base plate and cover plate members secured by snap fit engagement means.

25. The valve of claim 1 wherein said valve housing is formed by base plate and cover plate members secured by twist locking engagement means.

26. The valve of claim 25 wherein said base plate in integral with said liquid inlet vertical column.

27. The valve of claim 1 wherein said actuator vent conduit bears an annular flange and spherical boss secured sealingly to a central aperture of said flexible diaphragm.

28. The valve of claim 1 wherein the upper end of said actuator vent conduit bears orifice means for air passage therethrough.

29. The valve of claim 1 including conduit means communicating from said chamber of said valve housing and bearing attachment means to secure its free end in communication with overflow conduit means of said tank.

* * * * *

UNITED STATES PATENT OFFICE

CERTIFICATE OF CORRECTION

Patent No. 4,094,327 Dated June 13, 1978

Inventor(s) Anthony R. Brandelli

It is certified that error appears in the above-identified patent and that said Letters Patent are hereby corrected as shown below:

Column 8, line 13, "an" should read -- as --.

Column 8, line 24, "in" should read -- is --.

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*